US009865952B2

(12) United States Patent
Bagung et al.

(10) Patent No.: US 9,865,952 B2
(45) Date of Patent: Jan. 9, 2018

(54) PLUG CONTACT WITH ORGANIC COATING AND PRINTED CIRCUIT BOARD ARRANGEMENT

(71) Applicant: CONTINENTAL AUTOMOTIVE GMBH, Hannover (DE)

(72) Inventors: Detlev Bagung, Bernhardswald (DE); Thomas Riepl, Bad Abbach (DE); Holger Schlotter, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 15/387,971

(22) Filed: Dec. 22, 2016

(65) Prior Publication Data

US 2017/0179628 A1 Jun. 22, 2017

(30) Foreign Application Priority Data

Dec. 22, 2015 (DE) ..... 20 2015 008 773

(51) Int. Cl.

| | |
|---|---|
| ***H01R 13/02*** | (2006.01) |
| ***H01R 13/03*** | (2006.01) |
| ***H01R 12/58*** | (2011.01) |

(52) U.S. Cl.

CPC ..... *H01R 13/03* (2013.01); *H01R 12/585* (2013.01)

(58) Field of Classification Search

CPC ..... H01R 13/03; H01R 12/585
USPC ..... 439/78–82, 86, 886
See application file for complete search history.

(56) References Cited

U.S. PATENT DOCUMENTS

| | | | |
|---|---|---|---|
| 6,136,460 | A | 10/2000 | Chen et al. |
| 6,524,644 | B1 | 2/2003 | Wengenroth |
| 8,153,271 | B2 | 4/2012 | Wessling |
| 8,932,090 | B2 | 1/2015 | Jaeckle et al. |
| 2010/0193573 | A1 | 8/2010 | Wessling |
| 2010/0314157 | A1 | 12/2010 | Schulte |
| 2014/0113504 | A1 | 4/2014 | Moser |

FOREIGN PATENT DOCUMENTS

| | | | |
|---|---|---|---|
| EP | 0407492 | B1 | 7/1997 |
| EP | 2062467 | B1 | 2/2012 |
| EP | 1615484 | B1 | 2/2015 |
| WO | 2009141075 | A1 | 11/2009 |
| WO | 2012175286 | A1 | 12/2012 |

*Primary Examiner* — Khiem Nguyen

(74) *Attorney, Agent, or Firm* — Laurence A. Greenberg; Werner H. Stemer; Ralph E. Locher

(57) ABSTRACT

A plug contact is provided for the provision of a press contact with a mating contact. The plug contact is composed of an electrically conductive material. The plug contact has a first contact section for the provision of the press contact. The first contact section has, at least in places, an electrically conductive organic coating, and the organic coating contains a metal, an alloy, and/or an electrically conductive polymer. A printed circuit board arrangement is also provided.

6 Claims, 1 Drawing Sheet

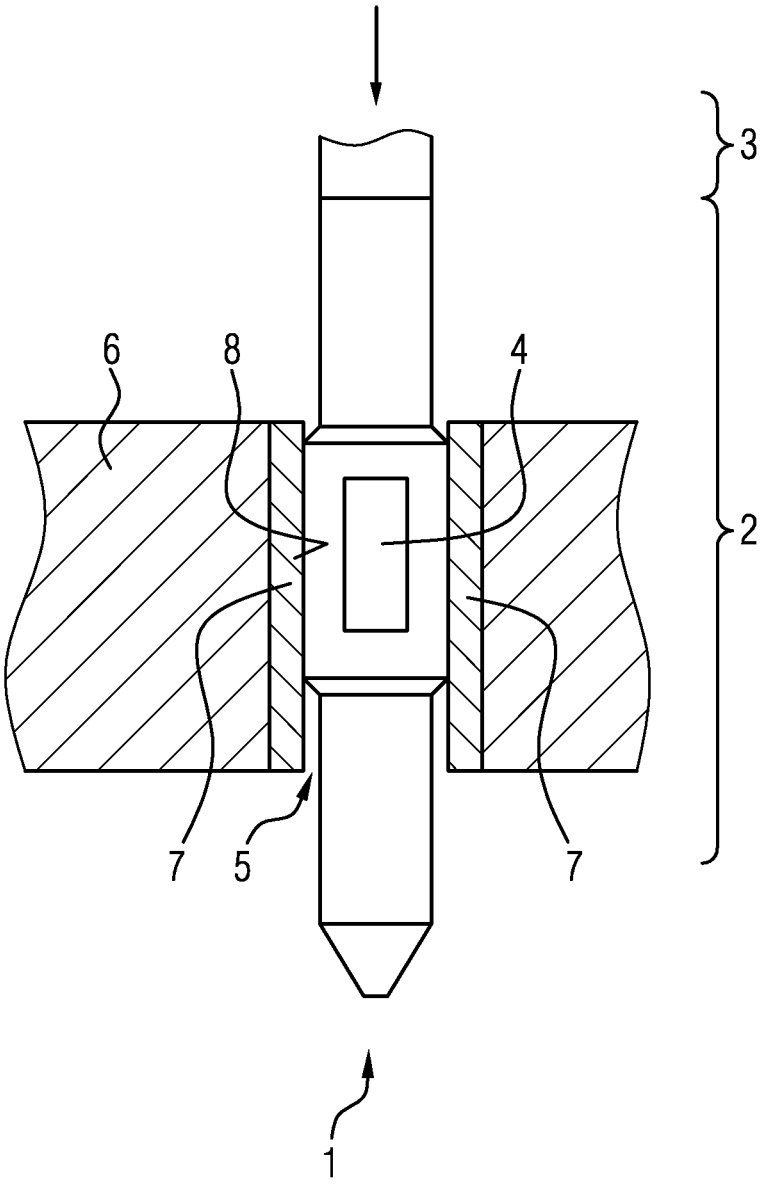
3
6
8
4
2
7
5
7
1

PLUG CONTACT WITH ORGANIC COATING AND PRINTED CIRCUIT BOARD ARRANGEMENT

CROSS-REFERENCE TO RELATED APPLICATION

This application claims the priority, under 35 U.S.C. §119, of German application DE 20 2015 008 773.6, filed Dec. 22, 2015; the prior application is herewith incorporated by reference in its entirety.

BACKGROUND OF THE INVENTION

Field of the Invention

The invention relates to a plug contact and a printed circuit board arrangement with a printed circuit board and the plug contact.

The prior art discloses plug contacts secured in a printed circuit board with the aid of a press contact. International patent disclosure WO 2009/141075 A1 discloses this type of contact.

SUMMARY OF THE INVENTION

Objects of the invention are provision of an improved plug contact and of an improved printed circuit board arrangement.

The objects are achieved via a plug contact and a printed circuit board arrangement as in the independent claims. Advantageous embodiments and further developments of the plug contact and of the printed circuit board arrangement are found in the dependent claims, in the description below, and in the drawing.

One aspect provides a plug contact for the provision of a press contact with a mating contact. The plug contact is in particular an electrical connection pin. It is composed of an electrically conductive material. Embodiments are also included here where the plug contact does not consist entirely of electrically conductive material; by way of example, it can have a nonconductive core and/or, in places, an electrically insulating coating. The plug contact has a first contact section for the provision of the press contact; the first contact section is in particular composed of a first axial end portion of the connection pin. The first contact section has, at least in places, an electrically conductive organic coating. The organic coating contains a metal, an alloy, and/or an electrically conductive polymer. The plug contact can by way of example be used for electrical contacting of a printed circuit board.

An advantage of the plug contact proposed is that the first contact section provided for the provision of a press contact has reliable protection from oxidation and at the same time has good—in particular good electrical—properties for the provision of a press contact.

In one embodiment the metal and, respectively, the alloy is present in the form of particles in the organic coating. It is preferable that the particles are in colloidal dispersion in an organic dispersion medium. This permits particularly inexpensive and/or easy production of the plug contact. A particularly good electrical press contact can be produced with this type of coating.

An electrically conductive polymer can provide good protection from corrosion and also sufficient electrical conductivity. The electrically conductive polymer contains by way of example polyaniline (PAni), polythiophene (PTh), polypyrrol (PPy), poly(3,4-ethylenedioxythiophene) (PEDT), Polythienothiophene (PTT), and/or a derivative of at least one of these materials, or consists of at least one of these materials.

In one embodiment tin is provided as metal in the organic coating. Good protection from oxidation can thus be obtained, as also can reliable electrical contact with the aid of a press contact.

In one embodiment the plug contact has a second contact section, where the second contact section is intended for connection with a second mating contact. The second contact section is in particular composed of a second axial end portion of the connection pin at an axial end of the connection pin that is opposite to the first axial end portion. The second contact section has, at least in places, an electrochemically deposited coating. The electrochemically deposited coating can likewise be used to achieve protection from corrosion and protection from wear of the second contact section. By way of example, the electrochemically deposited coating can contain tin. An underlying structure of the plug contact can by way of example consist of copper.

In another embodiment the organic coating contains a triazole, imidazole, or benzimidazole, or a derivative of one of these materials. By way of example, the organic coating has been produced from a solution of triazole, imidazole, or benzimidazole, or of derivatives of these. It is thus possible to achieve easy and reliable organic coating of the plug contact. This/these material(s) is/are present in the organic coating in one embodiment in the form of dispersion medium or of constituent of the dispersion medium in which the particles are preferably in colloidal dispersion.

In another aspect a printed circuit board arrangement with a printed circuit board and the plug contact is provided. The printed circuit board has a contact hole. The contact hole has an electrically conductive contact layer. The first contact section of the plug contact is arranged in the contact hole, and has press-fitting electrical and mechanical connection with the contact layer. The first contact section has in particular been pressed into the contact layer. The contact layer in particular extends around the first contact section.

Further advantages and advantageous embodiments and developments of the plug contact and of the printed circuit board arrangement will be apparent from the inventive example presented below in conjunction with the FIGURE.

Other features which are considered as characteristic for the invention are set forth in the appended claims.

Although the invention is illustrated and described herein as embodied in a plug contact with an organic coating and a printed circuit board arrangement, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The single FIGURE of the drawing is a diagrammatic longitudinal sectional view of a detail of a printed circuit board arrangement according to the invention.

DETAILED DESCRIPTION OF THE INVENTION

Referring now to the single FIGURE of the drawing in detail, there is shown a printed circuit board arrangement which has a plug contact 1 and a printed circuit board 6. The plug contact 1 is a connection pin, depicted in unsectioned form in the FIGURE. It has a first contact section 2 and a second contact section 3 at opposite axial ends in relation to a longitudinal axis. There is a pressure-insertion zone 4 provided in the first contact section 2. The pressure-insertion zone 4 can contain an aperture, e.g. in order to achieve comparatively high elastic radial deformability of the pressure-insertion zone 4. The plug contact 1 has been pressed into a contact hole 5 of the printed circuit board 6 so as to produce a solder-free electrical connection between the plug contact 1 and the printed circuit board 6. To this end, an electrically conductive contact layer 7 has been provided on an internal wall of the contact hole 5. When the plug contact 1 is pressed into the contact hole 5, the press-insertion zone 4 is deformed and connected mechanically with the contact layer 7. An electrical connection is thus also produced between the plug contact 1 and the contact layer 7. The press-insertion zone 4 can also contain fillets. The fillets are not depicted in the FIGURE. They preferably extend longitudinally. By means of the fillets it is possible to achieve a particularly high degree of local deformation of the contact layer 7, thus permitting achievement of particularly good electrical and mechanical connection between plug contact 1 and printed circuit board 6.

The plug contact 1 has, at least in some places, a coating 8 on the first contact section 2, which contains at least the pressure-insertion zone 4. The coating 8 contains an electrically conductive organic coating or is an electrically conductive organic coating 8. The organic coating contains a metal. Metals provided can by way of example be tin or other metals. The organic coating can be produced from a solution of triazole, imidazole, benzimidazole, or of derivatives of these. The organic coating can moreover contain an electrically conductive polymer. The organic coating can also comprise phenylimidazole, benzimidazole, aminothiols, acetates, polyalcohols, and/or diketones.

Before insertion of the plug contact 1 into the printed circuit board 6 there can be, if required by the selected embodiment, a volatile lubricant provided in the contact hole 5 and/or at the pressure-insertion zone 4 of the plug contact 1.

The plug contact has, at the second contact section 3, by way of example, an electrochemically deposited coating. In the inventive example depicted the second contact section 3 is at a distance from the first contact section 2 at an axial end of the plug contact 1, pointing away from the printed circuit board 6. The second contact section 3 is provided in order by way of example to produce electrical contact to a control device.

Various possible organic coatings which can be used for the coating of the first contact section of the plug contact are described below:

By way of example, the coating contains at least one electrically conductive polymer as defined below, preferably used in the form of an organic metal. Combinations of various substances from this class of substance can be used. The term polymers means by way of example organic polymers. The term electrically conductive polymers or conductive polymers, also called "intrinsically conductive polymers", means substances which are composed of low-molecular-weight compounds (monomers), and which by virtue of polymerization are at least oligomeric, i.e. comprise at least three monomer units which have been linked by chemical bonding, in the neutral (non-conductive) state have a conjugated electron system, and can be converted into an ionic form by oxidation, reduction, or protonation (the term "doping" often being used here), where said ionic form is conductive. Conductivity is at least $10^{-7}$ S/cm, and is usually below $10^{5}$ S/cm. Examples of dopants used are, in the case of doping via oxidation, iodine, peroxides, Lewis acids and protic acids, and in the case of doping via reduction sodium, potassium, and calcium. Conductive polymers can have an extremely wide variety of chemical compositions. Examples of monomers that have are acetylene, benzene, naphthalene, pyrrole, aniline, thiophene, Phenylene-conductive polymers can have an extremely wide variety of chemical compositions. Examples of monomers that have proven successful are acetylene, benzene, naphthalene, pyrrole, aniline, thiophene, phenylene sulfide, peri-naphthalene, and others, and also derivatives of these, for example sulfoaniline, ethylenedioxythiophene, thienothiophene, and others, and also alkyl and alkoxy derivatives of these, and derivatives having other pendant groups, for example sulfonate groups, phenyl groups, and other pendant groups. Combinations of the abovementioned monomers can also be used as monomer. By way of example, aniline and phenylene sulfide are linked here, and these A-B dimers are then used as monomers. If required by the objectives set, it is possible by way of example to bond pyrrole, thiophene, or alkylthiophenes, ethylenedioxythiophene, thienothiophene, aniline, phenylene sulfide, and other compounds to one another to give A-B structures and then to react these to give oligomers or polymers.

Most conductive polymers exhibit some extent of increase of conductivity with increasing temperature, this signifying that they are non-metallic conductors. Other conductive polymers exhibit, at least in a temperature range close to room temperature, metallic behavior, insofar as conductivity decreases with increasing temperature. Another method of recognizing metallic behavior consists in plotting what is known as "reduced activation energy" of conductivity against temperature at low temperatures (extending almost to 0 K). Conductors with a metallic contribution to conductivity exhibit a positive gradient of the curve at low temperature. Substances of this type are termed "organic metals". Organic metals are known per se. Preferred intrinsically conductive polymers are those mentioned above. Particular examples that may be mentioned are: polyaniline (PAni), polythiophene (PTh), poly(3,4-ethylenedioxythiophene) (PEDT), polydiacetylene, polyacetylene (PAc), polypyrrole (PPy), polyisothianaphthene (PITN), polyheteroarylenevinylene (PArV), where the heteroarylene group can be by way of example thiophene, furan, or pyrrole, poly-p-phenylene (PpP), polyphenylene sulfide (PPS), polyperi-naphthalene (PPN), polyphthalocyanine (PPc) etc., and also derivatives of these (formed by way of example from monomers substituted with pendant chains or pendant groups), copolymers of these, and physical mixtures of these. Particular preference is given to polyaniline (PAni), polythiophene (PTh), polypyrrol (PPy), poly(3,4-ethylenedioxythiophene) (PEDT), Polythienothiophene (PTT), and derivatives of these, and also mixtures thereof. Polyaniline is most preferred.

The organic coating can comprise, alternatively, or in addition, at least one noble metal selected from the group of Ag, Au, Pt, Pd, Rh, Ir, Ru, Os, and Re, and/or one seminoble metal selected from the group of Ni, Ti, Cu, Sn, and Bi.

The organic coating can contain—in particular additionally—other substances—by way of example non-electrically-conductive components. In one embodiment it contains polymer blends, i.e. mixtures of conductive polymer/organic metal (or of a combination of a plurality) with non-electrically-conductive polymers. Particularly suitable non-conductive polymers are water-soluble or water-dispersible polymers, in particular polystyrenesulfonic acid, polyacrylates, polyvinyl butyrates, polyvinylpyrrolidones, polyvinyl alcohols, and mixtures thereof. Conductive and non-conductive polymers, in particular polystyrenesulfonic acid, polyacrylates, polyvinyl butyrates, polyvinylpyrrolidones, polyvinyl alcohols, and mixtures thereof. Conductive and non-conductive polymers are preferably used in a ratio of from 1:1.5 to 1:20. The organic coating can also comprise further additives, in particular viscosity regulators, flow assistants, drying assistants, gloss improvers, matting agents, and mixtures thereof, preferably at a concentration of from 0.01 to 5% by weight of additive, based on the composition of the further layer.

The organic coating preferably contains from 15 to 40% of conductive polymer and from 15 to 40% of one or more noble metals and, respectively, seminoble metals, based on the composition of the organic coating. It has been found that a combination of the one or more conductive polymers/organic metals with complexing agents capable of complexing copper can be advantageous. Preferred complexing agents are imidazoles, benzimidazoles, or comparable complexing agents, for example benzotriazoles, thiourea, imidazole-2-thiones, and mixtures thereof, where these feature relatively good thermal stability.

Any of the materials used in printed circuit board technology is suitable as base layer of the printed circuit board 6 to which the contact layer 7 has been applied, particularly suitable materials being epoxys and epoxy composites, Teflon, cyanate esters, ceramic, cellulose, and cellulose composites, for example paperboard, materials based on these substances, and also flexible base layers, for example those based on polyimide. The layer thickness of the base layer is preferably from 0.1 to 3 mm. In one embodiment the contact layer 7 is, or comprises, a copper layer or a copper-alloy layer, the thickness of the contact layer preferably being from 5 to 210 μm, particularly from 15 to 35 μm. The copper layer or copper-alloy layer can have a covering of another metal layer or alloy layer. The metal layer or alloy layer preferably contains silver, tin, gold, palladium, or platinum. In one preferred embodiment the metal layer or alloy layer comprises mainly, i.e. to an extent of more than 50% by weight, based on the composition of the metal layer or alloy layer, one or more of the metals mentioned. The metals mentioned can in particular be present in the form of alloy with copper. In another preferred embodiment the metal layer or alloy layer consists exclusively of the metals mentioned, either in pure form or in the form of an alloy. The layer thickness of the metal layer or alloy layer is preferably from 10 to 800 nm. The metal layer or alloy layer can contain, alongside the metal or the alloy, organic components at a concentration that is preferably from 1 to 80% by weight, based on the entire composition of the metal layer or alloy layer (proportion of metal from 20 to 99% by weight). Preferred organic components are conductive polymers or organic metals, or organic copper-complexing agents, for example thiourea, benzotriazoles.

The organic metals described are particularly suitable for the production of coatings for plug contacts. The plug contact can be a contact pin.

It is preferable that the organic coating 8 is applied to the plug contact 1 in that the latter is, for example after rinsing with water, treated with a dispersion of the one or more conductive polymers or organic metals in a dispersion medium which is liquid at room temperature, for example via immersion of the plug contact into the dispersion or via application of the latter to the plug contact. The one or more electrically conductive polymers are preferably present in colloidal form in the dispersion medium. The one or more noble metals and, respectively, seminoble metals are present as water-soluble ions in the dispersion medium; alternatively, they can likewise be present in colloidal form in the dispersion medium.

Additional components, for example non-electrically-conductive polymers and additives, can be present in solution in the dispersion medium or be present likewise in colloidal form therein. Suitable dispersion media are organic solvents, preferably water-miscible organic solvents, water, and mixtures thereof. Preferred water-miscible solvents are alcohols, in particular alcohols with boiling point above 100° C. and preferably below 250° C. After application of the dispersion to the plug contact the latter is carefully dried, and further dispersion is optionally applied until the desired layer thickness has been reached. Production of suitable dispersions and use thereof for the coating procedure is known from the prior art: cf. by way of example European patent EP 0 407 492 B1. Water and aqueous solvents are preferred as dispersion medium.

In another embodiment the dispersions of one or more conductive polymers or organic metals and the solutions of the one or more noble/seminoble metals can be used in succession separately from one another; the conductive polymer dispersion serves as pretreatment here, and the noble/seminoble metal is then deposited on the Cu surface pretreated with the conductive polymer/organic metal.

A particular feature of the plug contacts 1 coated in the invention is that, even after a relatively long period of storage, they are not only amenable to successful soldering but also are amenable to multiple soldering, i.e. can be used in multistage soldering processes known as reflow processes. In this respect it was possible to come close to achievement of the properties of (much thicker) metallic coatings.

The organic coating 8 of the first contact section 2 can comprise from 5 to 45% of at least one intrinsically conductive polymer. The coating 8 can comprise from 5% to 45% of at least one noble metal selected from the group consisting of Ag, Au, Pd, Pt, Rh, Ir, Ru, Os, Re, or of at least one seminoble metal selected from the group consisting of Ni, Ti, Cu, Sn, Bi, or a mixture thereof, based on the composition of the coating 8, where the layer thickness of the organic coating 8 can be from 10 nm to 1 μm. The layer thickness of the coating 8 can be less than 500 nm. The coating 8 can also moreover comprise at least one non-electrically-conductive component. The coating 8 can comprise at least one complexing agent.

The coating 8 can contain a complexing agent from benzimidazoles, from imidazoles, from benzotriazoles, from thiourea, from imidazole-2-thiones, and mixtures thereof. The intrinsically conductive polymer can contain polyaniline (PAni), polythiophene (PTh), polypyrrole (PPy), poly (3,4-ethylenedioxythiophene) (PEDT), Polythienothiophene (PTT), derivatives of these, and mixtures thereof. The coating can contain epoxy, epoxy composite, Teflon, cyanate ester, ceramic, cellulose, cellulose composite, paperboard, and/or polyimide.

The organic coating 8 can contain halogens, substituted or unsubstituted halogenated alkyl groups and substituted or unsubstituted halogenated aryl groups, hydrogen, nitro groups, carboxylic acid groups, sulfonic acid groups, alkyl groups substituted with carboxylic acid groups or with sulfonic acid groups and aryl groups substituted with carboxylic acid groups or sulfonic acid groups, or a benzimidazole derivative, lower dialkylamino groups, lower alkoxy groups, cyano groups, acetyl groups, benzoyl groups, carbamoyl groups, formyl groups, carboxy groups, lower alkodylcarbonyl groups, and nitro groups.

The organic coating 8 can be applied in the form of solution with pH range from 1 to 5, with a salt-forming acid, where the aqueous solution has a metal content that is by way of example less than 50 ppm. The metal can be a heavy metal selected from the group containing by way of example tin, copper, manganese, and zinc.

The organic coating 8 of the plug contact 1 which in particular has an underlying structure made of copper or copper alloy, can be applied by the following process.

By deposition of a metallic surface layer containing a noble metal on the surface of the first contact region 2; wetting of the metallic surface layer with an aqueous composition containing: a first organic molecule which comprises at least one functional group and which interacts with the surface of the plug contact—in particular the noble metal of the metallic surface layer—and protects said metal, a second organic molecule having at least one functional group which interacts with the material of the underlying structure, in particular copper, and protects the material, and a surfactant.

The first organic molecule is by way of example selected from the group consisting of thiols (mercaptans), disulfides, thioethers, thioaldehydes, thioketones, and combinations thereof. The first organic molecule can be a thiol having the following general structure: R1-S—H, where R1 is either a hydrocarbyl group of from one carbon atom to 24 carbon atoms or an aryl group of from about five to about fourteen carbon atoms.

The thiol is by way of example selected from the group consisting of ethanethiol; 1-propanethiol; 2-propanethiol; 2-propene-1-thiol; 1-butanethiol; 2-butanethiol; 2-methyl-1-propanethiol; 2-methyl-2-propanethiol; 2-methyl-1-butanethiol; 1-pentanethiol; 2,2-dimethyl-1-propanethiol; 1-hexanethiol; 1,6-hexanedithiol; 1-heptanethiol; 2-ethylhexanethiol; 1-octanethiol; 1,8-octanedithiol; 1-nonanethiol; 1,9-nonanedithiol; 1-decanethiol; 1-adamantanethiol; 1,11-undecanedithiol; 1-undecanethiol; 1-dodecanethiol; tert-dodecyl mercaptan; 1-tridecanethiol; 1-tetradecanethiol; 1-pentadecanethiol; 1-hexadecanethiol; 1-heptadecanethiol; 1-octadecanethiol; 1-nonadecanethiol; and 1-icosanethiol; and combinations thereof.

The thiol is by way of example selected from the group consisting of thiophenol; 2-methylbenzenethiol; 3-methylbenzenethiol; 4-methylbenzenethiol; 2-ethylbenzenethiol; 3-ethylbenzenethiol; 4-ethylbenzenethiol; 2-propylbenzenethiol; 3-propylbenzenethiol; 4-propylbenzenethiol; 2-tert-butylbenzenethiol; 4-tert-butylbenzenethiol; 4-pentylbenzenethiol; 4-hexylbenzenethiol; 4-heptylbenzenethiol; 4-octyl-benzenethiol; 4-nonylbenzenethiol; 4-decylbenzenethiol; Benzyl mercaptan; 2,4-xylenethiol, furfuryl mercaptan; 1-naphthalenethiol; 2-naphthalenethiol; 4,4'-dimercaptobiphenyl; and combinations thereof.

The first organic molecule can be a disulfide having the following structure: R1-S—S—R2, in which R1 and R2 are respectively independently of one another a hydrocarbyl group of from one carbon atom to 24 carbon atoms or an aryl group of from about five to about fourteen carbon atoms.

The disulfide is by way of example selected from the group consisting of diethyl disulfide, di-n-propyl disulfide, diisopropyl ether disulfide, diallyl disulfide, di-n-butyl disulfide, di-sec-butyl disulfide, diisobutyl ketone disulfide, di-tert-butyl disulfide, di-n-pentyl disulfide, dineopentyl disulfide, di-n-hexyl disulfide, di-n-heptyl disulfide, di-n-octyl disulfide, di-n-nonyl disulfide, di-n-decyl disulfide, di-n-dodecyl disulfide, di-n-tridecyl disulfide, di-n-tetradecyl disulfide, di-n-pentadecyl disulfide, di-n-hexadecyl disulfide, di-n-heptadecyl disulfide, di-n-octadecyl disulfide, di-n-decyl disulfide; diundecyl phthalate disulfide, didodecyl disulfide, dihexadecyl disulfide, dibenzyl disulfide dithienyl disulfide, 2-naphthyl disulfide, and combinations thereof.

The second organic molecule is selected from the group consisting of primary amines, secondary amines, tertiary amines, aromatic heterocycles involving nitrogen, and combinations of these.

The second organic molecule is by way of example a primary amine, a secondary amine, or a tertiary amine having the following general structure:

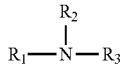

in which R1, R2, and R3 are respectively independently hydrogen or a hydrocarbyl group of from one carbon atom to 24 carbon atoms, and at least one of the moieties R1, R2, and R3 is a hydrocarbyl group of from one carbon atom to 24 carbon atoms.

The amine is by way of example selected from the group consisting of aminoethane, 1-aminopropane, 2-aminopropane, 1-aminobutane, 2-aminobutane, 1-amino-2-methylpropane, 2-amino-2-methyl, 1-aminopentane, 2-aminopentane, 3-aminopentane, neopentylamine, 1-aminohexane, 1-aminoheptane, 2-aminoheptane, 1-aminooctanes, 2-aminooctanes, 1-amino-nonanes, 1-aminodecanes, 1-aminododecanes, 1-aminotridecanes, 1-aminotetradecanes, 1-aminopentadecanes, 1-aminohexadecanes, 1-aminoheptadecanes, 1-aminooctadecane, and combinations thereof.

The second organic molecule is by way of example an azole having the following general structure:

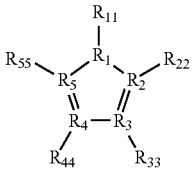

where each of R1, R2, R3, R4, and R5 is an atom selected from the group consisting of carbon and nitrogen. From one to four of the moieties R1, R2, R3, R4, and R5 here is/are nitrogen, and from one to four of the groups R1, R2, R3, R4, and R5 is/are carbon; and R11, R22, R33, R44, and R55 are respectively independently selected from the group consisting of hydrogen, carbon, sulfur, oxygen, and nitrogen.

The azole is for example selected from the group consisting of pyrrole (1H-azole); imidazole (1,3-diazole); pyrazole (1,2-diazole); 1,2,3-triazole; 1,2,4-triazole; tetrazole; isoindole; indole (1H-benzo[b]pyrrole); benzimidazole (1,3-benzodiazole); indazole (1,2-benzodiazole); 1H-benzotriazole; 2H-benzotriazole; imidazo[4,5-b]pyridine; purine (7H-imidazo(4,5-d)pyrimidine); pyrazolo[3,4-d]pyrimidine; triazolo[4,5-d]pyrimidine; and combinations thereof.

The azole is by way of example selected from the group consisting of 2-(3,4-dichlorobenzyl)benzimidazole; 2-bromobenzylbenzimidazole; 2-bromophenylbenzimidazole; 2-bromoethylphenylbenzimidazole; 2-chlorobenzylbenzimidazole; 2-chlorophenylbenzimidazole; 2-chloroethylphenylbenzimidazole; and combinations thereof.

The first organic molecule is by way of example present at a concentration of from about 1 to about 10 g/liter, and the second organic molecule is present at a concentration of from about 1 to about 10 g/liter.

The invention claimed is:

1. A plug contact for a press contact having a mating contact, the plug contact comprising:

a plug contact body composed of an electrically conductive material, said plug contact body having a first contact section for provision of the press contact, said first contact section having, at least in places, an electrically conductive organic coating, said electrically conductive organic coating including at least one of a metal, an alloy, or an electrically conductive polymer;

said plug contact body having a second contact section configured for connection with a second mating contact, said second contact section having, at least in places, an electrochemically deposited coating, and said second contact section spaced away from said electrically conductive organic coating.

2. The plug contact according to claim 1, wherein said electrically conductive organic coating including at least one of the metal or the alloy, said metal and, respectively, said alloy is present in a form of particles in said electrically conductive organic coating, and said particles are in colloidal dispersion in an organic dispersion medium.

3. The plug contact according to claim 2, wherein said metal is tin.

4. The plug contact according to claim 1, wherein said electrically conductive organic coating includes at least one of a triazole, imidazole, benzimidazole, or a derivative of at least one of these substances.

5. The plug contact according to claim 1, wherein said electrically conductive organic coating includes said electrically conductive polymer and said electrically conductive polymer contains at least one of polyaniline (PAni), polythiophene (PTh), polypyrrole (PPy), poly(3,4-ethylenedioxythiophene) (PEDT), Polythienothiophene (PTT), or a derivative of at least one of these materials.

6. A printed circuit board configuration, comprising:

a printed circuit board having a contact hole formed therein and an electrically conductive contact layer disposed around said contact hole; and a plug contact composed of an electrically conductive material and having a first contact section disposed in said contact hole, said plug contact having a press-fitting electrical and mechanical connection to said electrically conductive contact layer, said first contact section having, at least in places, an electrically conductive organic coating, and said electrically conductive organic coating including at least one of a metal, an alloy, or an electrically conductive polymer;

said plug contact having a second contact section configured for connection with a second mating contact, said second contact section having, at least in places, an electrochemically deposited coating, and said second contact section spaced away from said electrically conductive organic coating.

* * * * *